US006264242B1

(12) United States Patent
Lenhart

(10) Patent No.: US 6,264,242 B1
(45) Date of Patent: Jul. 24, 2001

(54) STICK HANDLE WITH WRIST STRAP

(76) Inventor: Klaus Lenhart, Mittlerer Weg 23, D-73230 Ohmden (DE)

( * ) Notice: Subject to any disclaimer, the term of this patent is extended or adjusted under 35 U.S.C. 154(b) by 0 days.

(21) Appl. No.: 09/230,651

(22) PCT Filed: Sep. 9, 1997

(86) PCT No.: PCT/EP97/04900

§ 371 Date: Jan. 29, 1999

§ 102(e) Date: Jan. 29, 1999

(87) PCT Pub. No.: WO98/10844

PCT Pub. Date: Mar. 19, 1998

(30) Foreign Application Priority Data

Sep. 11, 1996 (DE) ..... 196 36 852

(51) Int. Cl.[7] ..... A63C 11/22
(52) U.S. Cl. ..... 280/822; 280/821
(58) Field of Search ..... 280/821, 819, 280/822; 135/66, 65, 76

(56) References Cited

U.S. PATENT DOCUMENTS

| | | | | |
|---|---|---|---|---|
| 3,113,786 | | 12/1963 | Phillipson . | |
| 3,297,333 | * | 1/1967 | Scwedt et al. | 280/823 |
| 3,658,356 | * | 4/1972 | Van Reyper | 280/823 |
| 4,593,933 | * | 6/1986 | Nunno | 280/823 |
| 4,779,896 | | 10/1988 | Ingalls . | |
| 5,110,154 | | 5/1992 | Street . | |
| 5,312,134 | | 5/1994 | Goode et al. . | |
| 5,443,287 | | 8/1995 | Wells . | |
| 5,470,108 | * | 11/1995 | Goode et al. | 280/823 |
| 5,549,330 | | 8/1996 | Wells . | |
| B1 6,139,060 | * | 10/2000 | Lenhart | 280/821 |

FOREIGN PATENT DOCUMENTS

| | | |
|---|---|---|
| 78 04 390 | 2/1978 | (DE) . |
| 78 04 728 | 2/1978 | (DE) . |
| 78 08 851 | 3/1978 | (DE) . |
| 28 08 549 | 6/1979 | (DE) . |
| 0 370 900 | 5/1990 | (EP) . |

OTHER PUBLICATIONS

Published PCT application WO 96/34665, Nov. 7, 1996.

* cited by examiner

*Primary Examiner*—Lanna Mai
*Assistant Examiner*—Jeffrey J. Restifo
(74) *Attorney, Agent, or Firm*—Jones, Tullar & Cooper, P.C.

(57) ABSTRACT

A handle for ski sticks and the like provided with a wrist strap. The wrist strap is attached to the stick handle by a first connecting element fixed at the wrist strap and a second connecting element lodged at the ski's stick handle, which are interlocked. To insure that the connection between the stick handle and the wrist strap is disengaged automatically only in case of danger and no inopportune releasing occurs, a flexible releasing device is installed, which holds one of the connecting elements at the interlocked position and yields only when the wrist strap is pulled in the same direction, a direction with a force component running longitudinally in the stick from its tip toward the handle, so that the second connecting element held together by the releasing device can be disengaged from its interlocked position.

21 Claims, 8 Drawing Sheets

FIG. 3
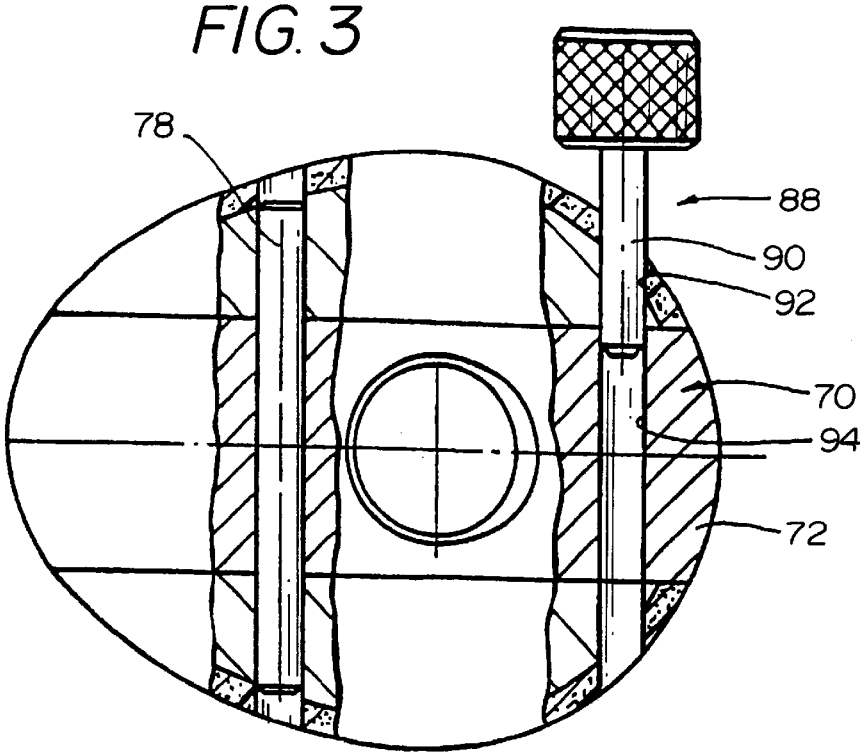
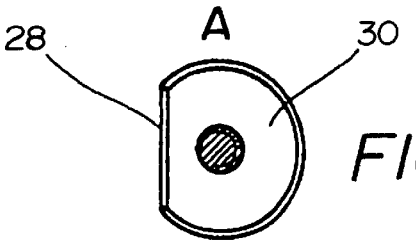
FIG. 4
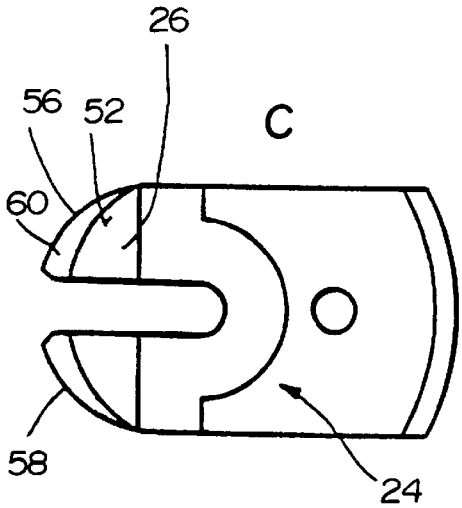
FIG. 6
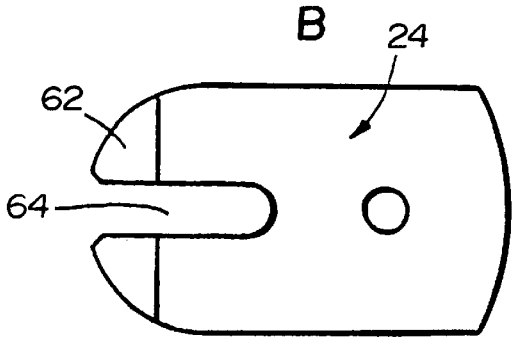
FIG. 5

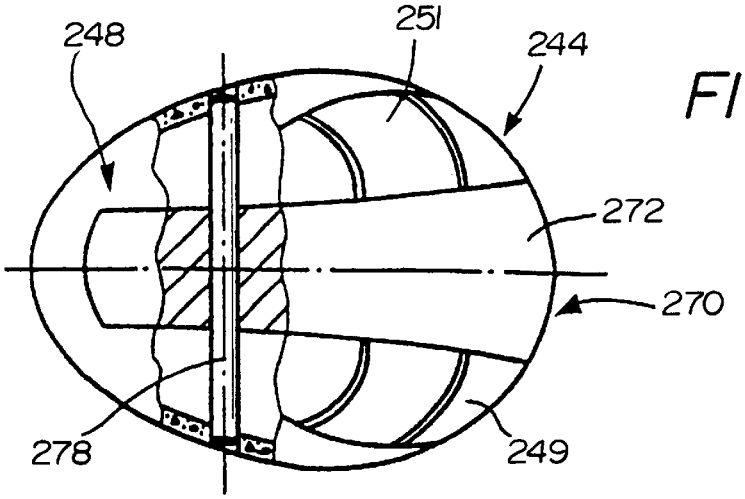
FIG. 15
FIG. 16
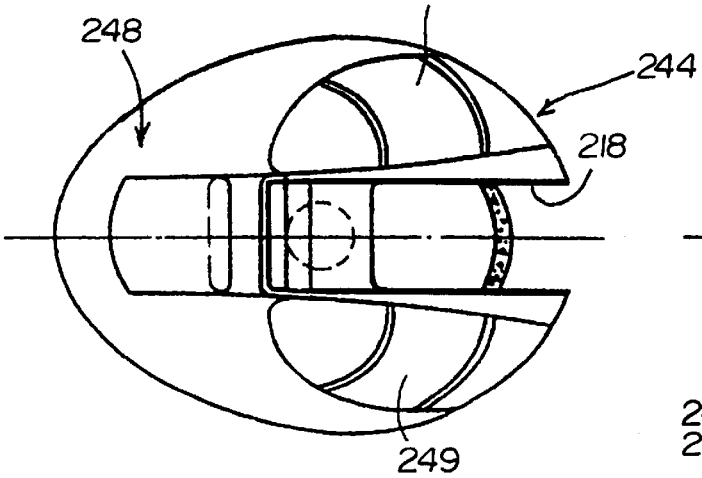
FIG. 17C
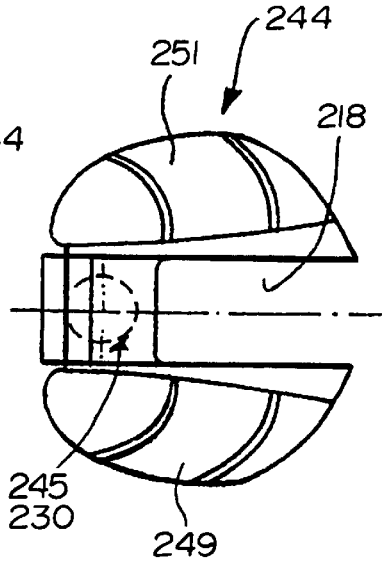
FIG. 17A
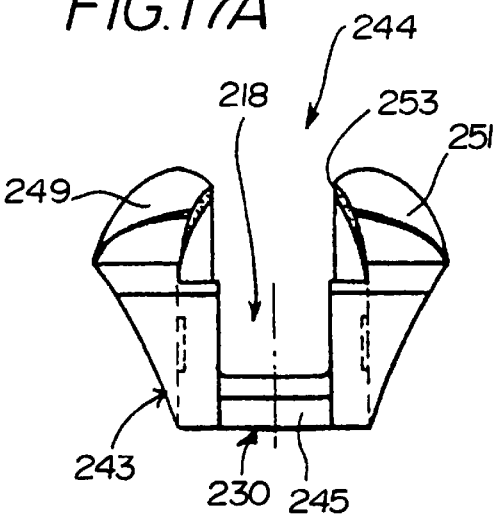
FIG. 17B
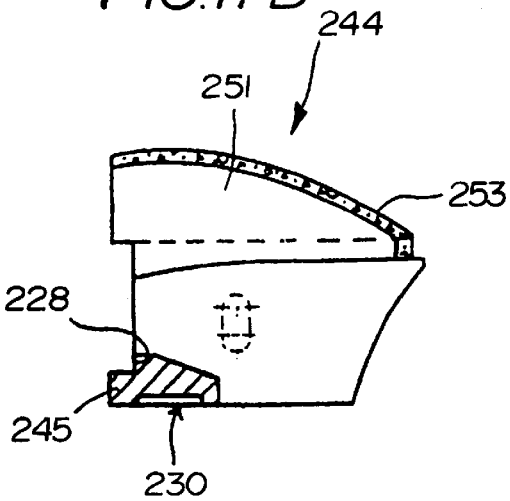

STICK HANDLE WITH WRIST STRAP

FIELD OF THE INVENTION

The present invention relates to a pole grip for ski poles, hiking canes, trekking canes and the like with a wrist strap which can be locked via a first connecting element fixed on the wrist strap with the pole grip in a manner which is releasable under a tensile load, the first connecting element being arranged in a recess in the pole grip.

BACKGROUND OF THE INVENTION

Commercially available ski poles with wrist straps fixed on the pole grip are relatively awkward to handle if it is necessary to pull the hands often out of the wrist straps, such as is necessary when riding a lift in the course of alpine skiing. So-called "epée grips" were developed, which no longer have wrist straps. In connection with these grips it is disadvantageous that they do not provide a sufficient support function for the skier and the pole is immediately lost when it is released.

In connection with a pole grip known from DE 28 08 549 A1, the first connecting element is embodied in the form of a fork on its end facing the wrist strap and can be locked in place by means of a holding pin, which is retained in a pole recess which is open toward the top. It is disadvantageous with this construction that to re-fasten the first connecting element with the pole grip after having released the safety device requires essentially as much strength as is required for releasing the safety device; in other words, re-fastening is awkward and elaborate. In addition, with this construction there is the chance of releasing the safety not only in the longitudinal direction of the pole, but also in a direction transversely to the pole grip, which is not desired. There is no possibility of releasing the wrist strap purposely and without an essential use of force from the pole grip.

In connection with a pole grip known from DE 78 04 390 U1, the connecting element can be releasably locked in place between a stationary pole grip face plate and an insert maintained in the pole handle, in a way in which the insert is resilient in a direction pointing toward the pole tip. Here, the above mentioned disadvantages essentially result, wherein the release device in particular is essentially opposite the one essential for a safety release.

Another known pole grip in accordance with DE 78 08 851 U1 uses a hinged cover on the front face of the grip head, which is flipped open by pulling on the wrist strap so that a free end of the wrist strap is released. Here it is difficult to reinsert the wrist strap in the safety release and to fix it in place under the cover to be locked, and then to reinsert the glove into the strap.

SUMMARY OF THE INVENTION

It is therefore an object of the present invention to provide a pole grip for ski poles, hiking canes, trekking canes and the like of the type mentioned at the outset wherein, after a safety release, the re-connection between the wrist strap and the pole grip can take place with a minimal insertion force independently of the size of the triggering force in a simple and rapid manner, and wherein the intentional release of the wrist strap from the pole grip without an essential exertion of force is provided.

In connection with a pole grip of the type mentioned, a second connecting element can be locked together with the first connecting element in the pole grip recess. The second connecting element can be resiliently seated in the longitudinal direction of the pole grip, and on its side facing the front face of the grip head, the recess is covered by an elastically yielding triggering mechanism, between which the second connecting element and the first connecting element are arranged. The second connecting element can be moved counter to the resilient seating by means of an actuating member which is accessible from the front face of the grip head.

It has been achieved by means of the steps in accordance with the present invention that, following a safety release, the first connecting element connected with the wrist strap can be rapidly and simply locked in the pole grip, or respectively between the front face of the grip head and the second connecting element. The exertion of force needed for this is small, since this merely is a function of the corresponding spring force acting on the second connecting element. In contrast to that, the force required for the safety release is a function of the setting of the resiliently yielding trigger plate. Different from the known solutions with covers, a restoring of the trigger plate is assured with the subject of the present invention because of the resiliently yielding trigger plate, so that the pole grip is always ready for the first connecting element being locked again. No further steps are required for this. Further than that, it is also possible with the pole grip in accordance with the present invention to purposely remove the wrist strap from the pole grip by a simple pressure on the actuating member.

When the first connecting element has a detent protrusion which extends behind the second connecting element, the triggering means for releasing need only give to an extent wherein the detent protrusion is freed. Then the first connecting element can be pulled out of the recess.

A preferred seating of the triggering means is provided with an upward oriented tensile pull on the wrist strap, the triggering means can be pivoted around the shaft which is advantageously arranged in accordance with claim 4, by means of which the locking between the first and the second connecting element is released.

According to one embodiment, the portion of the plate which is to be pivoted rests on a spring-elastic element, so that the compressibility of the spring-elastic element in the end determines the tensile load required for triggering. Alternatively, the element of the triggering means which is to be pivoted has a spring-elastic protrusion extending in the longitudinal direction of the pole grip which is supported on a shoulder in the pole handle.

Alternative embodiments include; triggering mechanism having a center opening in which the actuating member is received the first connecting element having a slit, which is axial in relation to the movement direction, on its inner end, through which a rod extends vertically, which is connected, fixed against relative movement, with the second connecting element and the actuating member arranged in the center axis; the first connecting element extending through a slit, extending in its direction of movement, in the rod, which is connected, fixed against relative movement, with the second connecting element and the actuating member arranged in the center axis; an opening being provided on both sides of the triggering mechanism, and the actuating member being received in the two openings; the actuating member having two actuating keys which penetrate through the openings; two actuating keys o the actuating member being arranged on a U-shaped base member, the base lag of the U-shaped base member constituting the second connecting element; the base member resting with its base leg on the upper end of a helical compression spring, which is guided in an axial blind bore recess; and two actuating keys being covered by a soft coating.

If the pole grip in accordance with the present invention is also intended for a use wherein triggering, even in case of a fall, is not desired, for example in connection with cross-country skiing, wherein the user often moves over difficult terrain and in deep snow and the ski pole must not be lost under any circumstances, the triggering means can be locked by means of a locking device. In this case the pole always remains connected to the hand of the user.

If the wrist strap has been integrated into a glove, the danger of losing the wrist strap is reduced.

The present invention will be explained in detail in what follows by means of several exemplary embodiments, making reference to the drawings. In the drawings are shown in:

BRIEF DESCRIPTION OF THE DRAWINGS

FIG. 3, is a view from above on the pole grip, partially viewed in section along the line III—III in FIG. 1, FIG. 4, is a sectional view along the line IV—IV in FIG. 1, FIG. 5 and FIG. 6, are views of the first connecting element from above, respectively from below, FIG. 15, is a partially broken view from above in accordance with the arrow XV in FIG. 14, FIG. 16, is a representation corresponding to FIG. 15, but with the triggering means removed, and FIGS. 17A to 17C, show an actuation member of the pole grip in accordance with FIG. 14, made of one piece with the second connecting element, in a longitudinal view, or respectively a view from above.

DESCRIPTION OF THE PREFERRED EMBODIMENTS

Figure 1:
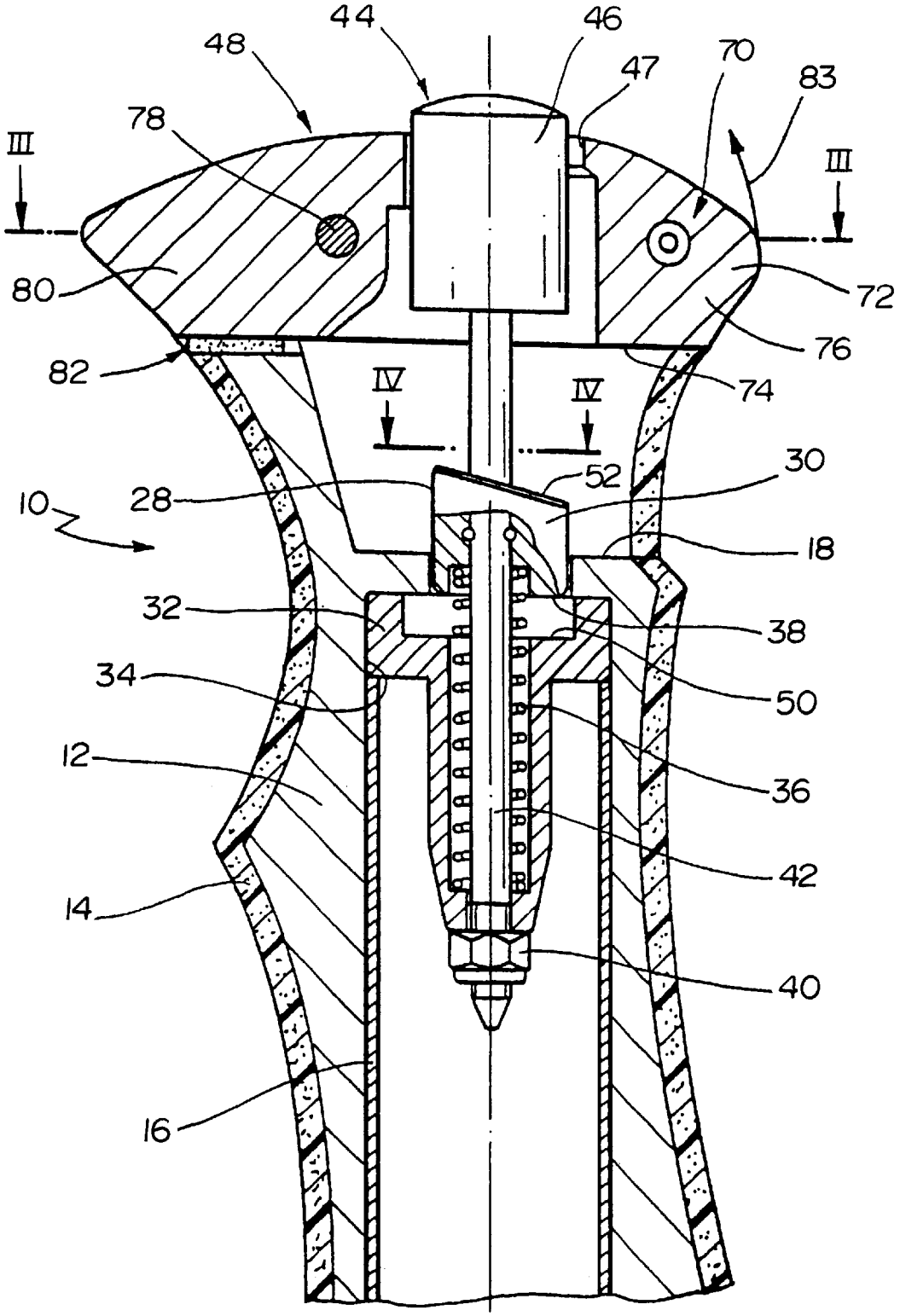
FIG. 1, is a longitudinal section of a pole handle without a wrist strap in accordance with a first exemplary embodiment of the present invention.
Figure 2:
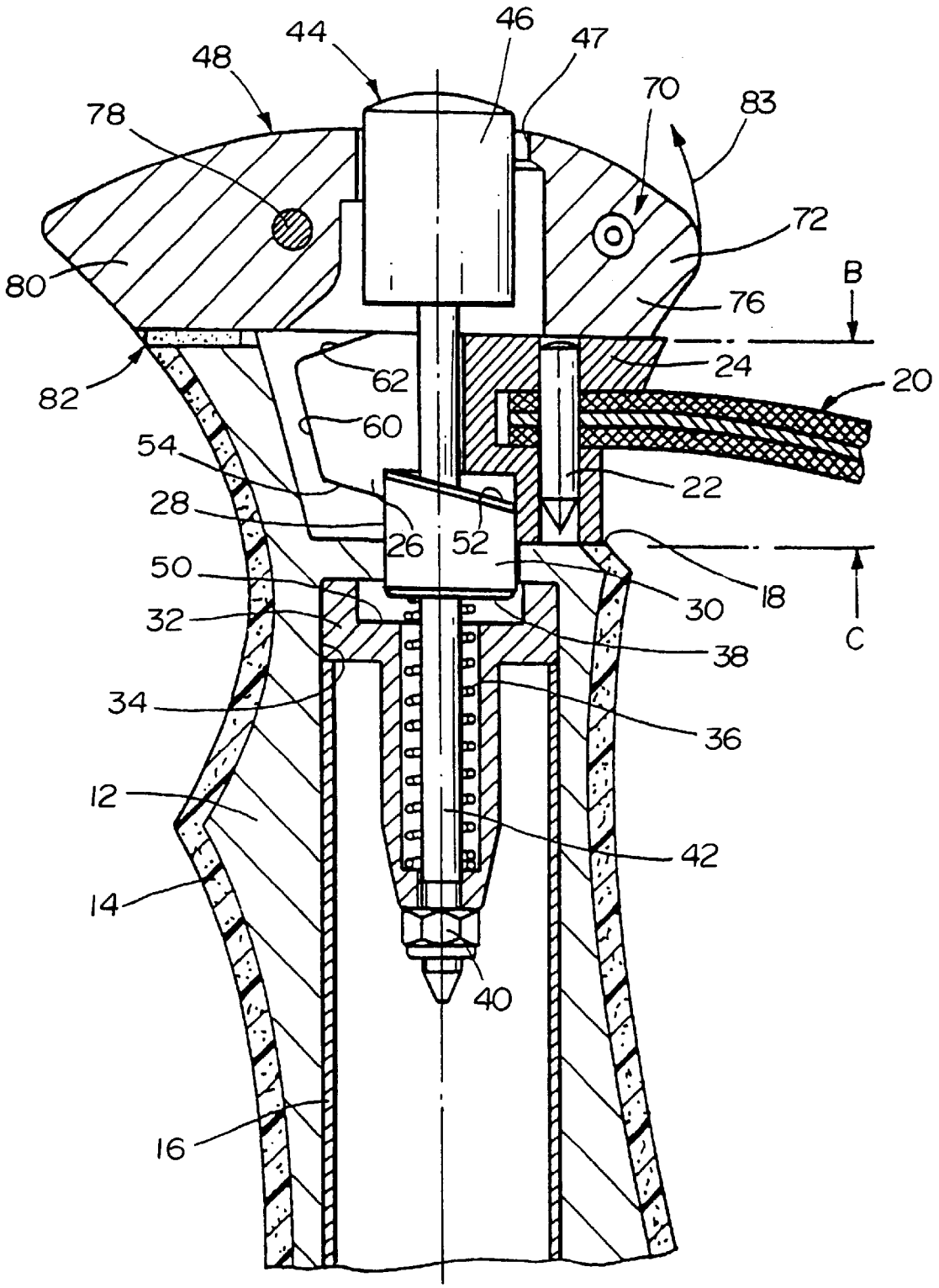
FIG. 2, is a representation as in FIG. 1, but with a wrist strap.

A pole grip 10 in accordance with a first exemplary embodiment represented in FIGS. 1 and 2 has a base body 12 made, for example, of an injection molded element of plastic. The base body 12 can be provided with a cover 14 of an easily gripped material. The pole grip has been placed on a pole tube 16 of a ski pole, hiking cane, trekking cane or the like.

In the area of its upper pole end piece, the pole grip 10 has a lateral recess 18, in which a wrist strap 20 is fastened. To this end the wrist strap 20 is fixedly connected via a securing pin 22 with a first connecting element 24 (FIG. 2). The first connecting element 24 can be pushed into the recess 18 and has a detent protrusion 26 which, in the state where the first connecting element has been pushed in, interlocking extends behind a detent edge 28 (FIG. 4) of a second connecting element 30.

The second connecting element 30 is seated, preferably resiliently movable in the longitudinal direction of the pole. A bushing 32 has been pressed into a recess 34, which also receives the pole tube 16, and in the inserted state rests on the pole tube 16 and is fixed in place in this way. A spring-elastic means 36, for example a helical spring, is received in the bushing 32 and on the end is supported in the bushing 32 and on the other end against an underside 38 of the second connecting element 30. So that the spring travel is upwardly limited, a securing nut 40 has been screwed on a rod 42, which passes through the helical spring 36 and the bushing 32 and is connected with the second connecting element 30. The rod 42 is a part of an actuating member 44, which is accessible via a control knob 46 from the direction of the front face 48 of the pole head. The second connecting element 30 is preferably extruded onto the rod 42. Thus, the second connecting element 30 is axially movable in the pole grip 10, is resiliently seated and can be moved downward in the axial direction by means of the actuating member 44 until the underside 38 touches a shoulder 50 of the bushing 32. After release of the actuating member 44 it is moved back, together with the second connecting element 30, into the initial position represented in FIG. 2 by means of the spring 36. The lock between the first and second connecting elements 24 and 30 can be released by pushing the actuating member 44 down. The wrist strap 20 can be separated from the pole grip 10. The detent, or respectively release path can be set by turning the securing nut 40.

In a preferred embodiment of the first and second connecting elements 24 and 30, the second connecting element 30 has a bevel 52 on its top, on which an also beveled surface 54 of the first connecting element is guided into the recess 18 when the first connecting element 24 is pushed in, so that the second connecting element 30 can be pushed down without tilting against the spring force of the spring 36, and the first connecting element 24 can be cleanly locked. To make the insertion of the first connecting element 24 easier, the latter has rounded portions 56 and 58 on its front face, as well as further bevels 60 and 62 (FIGS. 2, 5 and 6). The first connecting element 24 has a slit 64 in the area of its front, wherein the rod 42 of the actuating member 44 is located in the pushed-in state.

Figure 11:
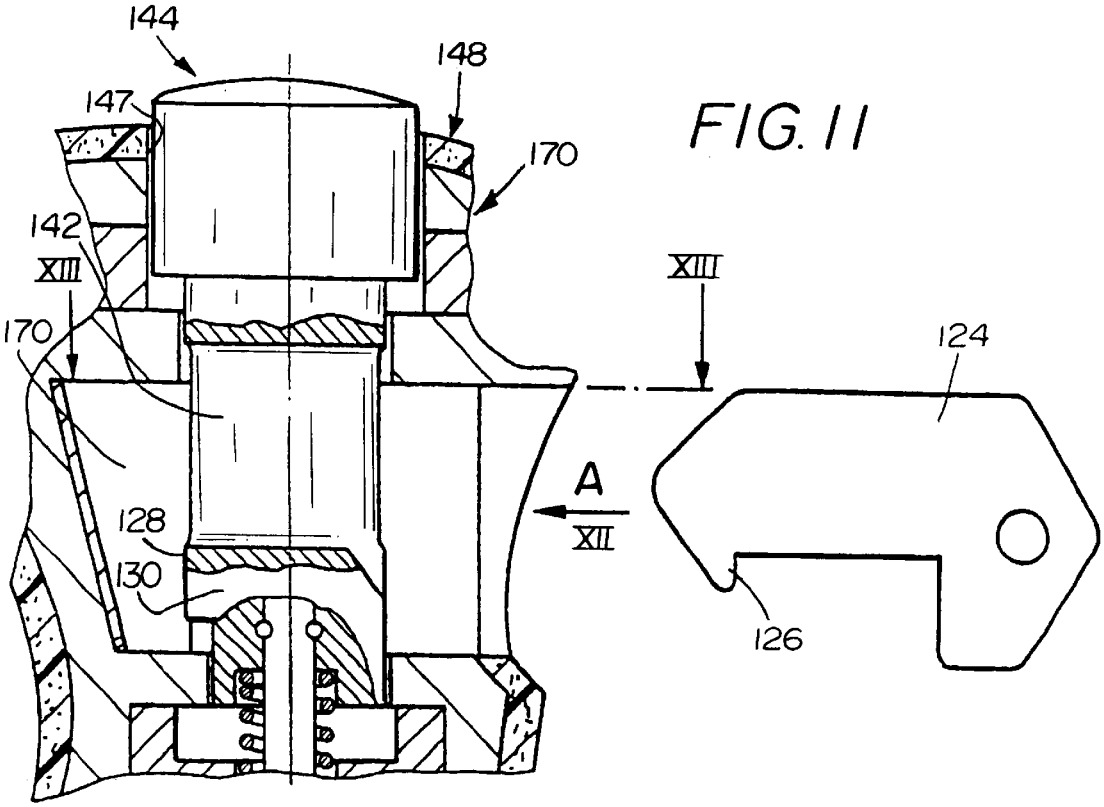
FIG. 11, is a representation similar to FIG. 1, but in parts and with a pole grip in accordance with a second exemplary embodiment of the present invention and prior to inserting the first connecting element.
Figure 12:
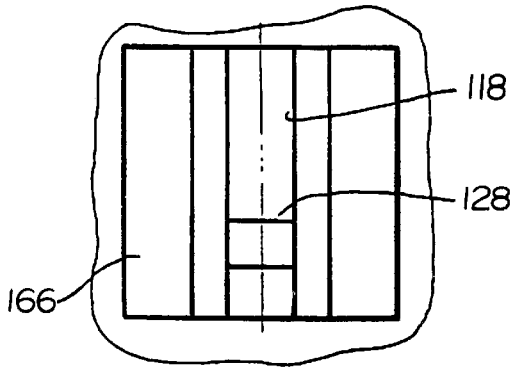
FIG. 12, is a plan view in accordance with XII in FIG. 11 in a broken representation.
Figure 13:
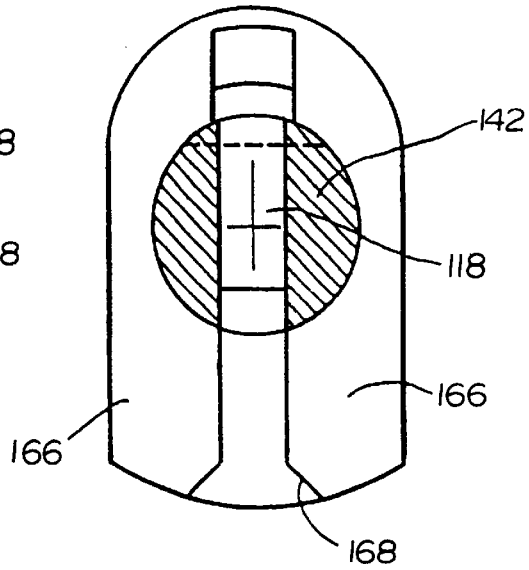
FIG. 13, is a sectional view along the line XIII—XIII in FIG. 11, FIG. 14, is a representation similar to FIG. 1, but with a pole grip in accordance with a third exemplary embodiment of the present invention.

A second exemplary embodiment of a pole grip 110 with the first and second connecting elements 124 and 130 is represented in FIGS. 11 to 13. In this exemplary embodiment, the diameter of the rod 142 of the actuating member 144 is embodied approximately as large as the second connecting member 130 and has a slit 118, through which the first connecting element 124 can be passed. A detent protrusion 126 extends interlockingly behind a detent edge 128, again of the second connecting element 130, or respectively of the rod 124 of the actuating member. In order to be able to insert the first connecting element 124 rapidly and simply, an insert 166 is provided having a funnel-like opening 168, wherein the funnel mouth terminates in the slit 118.

In accordance with the present invention, a resilient triggering means 70, or respectively 170 is provided, by means of which one of the connecting elements 24, 30, or respectively 124, 130 is held in the locked position, which only yields in case of a tensile load on the wrist strap 20 in the direction of a force component extending in the longitudinal direction of the pole, whose direction points from a pole tip to the pole grip, i.e. in accordance with FIGS. 1 and 2, or respectively 11, toward the top, so that the connecting element 24, 30, or respectively 124, 130, which is held by the triggering means 70, or respectively 170, can be brought out of its locked position.

With the first exemplary embodiment in accordance with FIGS. 1 to 10, the resilient triggering means 70 is formed by a cover 72, which constitutes a side 74 of the recess 18 facing the front face of the pole grip. Here, the cover 72 consists of a plate 76, which is seated pivotable around a shaft 78. In the course of pivoting the plate 76 in the direction of the arrow 83, the recess 18 is opened toward the top, so to speak, so that the first connecting element 24 is no longer maintained in the locked position (FIG. 2) and can be removed from the pole grip 10 without pushing the actuating member 44 down. An element 80 of the plate 76 rests on a spring-elastic element 82, which is compressed when the plate 76 is pivoted in the direction of the arrow 83. In connection with a simple variation represented in FIG. 2, the spring-elastic element 82 is constituted by a cushion of an elastic material.

Figure 7:
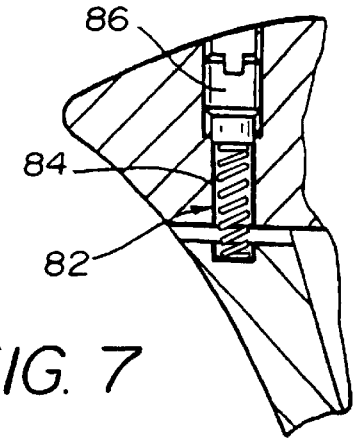
FIG. 7, is a cross section of a partial area of the pole head in accordance with a variant of the present invention.

In a variant represented in FIG. 7, the spring-elastic element 82 is formed by a helical spring 84, whose spring-elastic force can be adjusted in that the spring 84 can be pre-compressed by means of a stud screw 86 screwed into the plate 76.

In case of a tensile load on the wrist strap 20 in the direction of a force component extending in the longitudinal direction of the pole, whose direction points from a pole tip to the pole grip, i.e. upward in accordance with FIGS. 1 and 2, the plate 76 is pivoted in the direction of the arrow 83 counter to the spring-elastic force of the spring-elastic element 82. If the tensile force on the wrist strap 75 is sufficiently large, the plate 76 is pivoted so far that the first connecting element 24 is lifted far enough so that the detent protrusion 26 no longer grips the second connecting element 30 from behind. In this case the wrist strap 20 with the first connecting element 24 is freed from the pole grip 10.

This triggering mechanism is furthermore aided in that, with an upward tensile load on the wrist strap, not only can the triggering means 70, i.e. the plate 76, yield upward, but also a slight rotation of the first connecting element 24 can occur, so that the second connecting element 30 is pushed slightly down by this, by which the unlocking is aided, so that the plate 76 need only be pivoted slightly.

In connection with a variant, not represented, the spring-elastic element 82, whose restoring power can be adjusted, is constituted by a cushion wedge of an elastic material, which is displaceably seated between the element 80, the plate 76 and the base body 12 along a bevel of the base body. The cushion wedge can be displaced, for example via a screw thread, so that the compression properties and therefore the restoring force and thereby the triggering force can be infinitely varied.

In a further, not represented variant of the present invention, the triggering means 70 can be constituted by the pole grip material, which then needs to be correspondingly resilient in the area of the front face 48 of the grip head in order to be able to yield upward in case of tensile loads on the wrist strap 20, so that the first connecting element 24 is unlocked. It would be conceivable in a further alternative for the cover 72 to be held by, for example, belts or burr tapes, which are opened under the appropriate load. It would also be possible to fasten the cover 72 by means of a frictional connection.

It is understood that the triggering means 170 in the second exemplary embodiment in accordance with FIGS. 11 to 13 can be embodied in accordance with the previously mentioned triggering means 70.

In a further embodiment of the present invention, the pole grip has a locking device 88, by which the triggering means 70, or respectively 170 can be locked. The locking device 88 comprises a locking pin 90, which can be inserted into a bore 92 cut into the pole grip and into a bore 94 of the triggering means 70, which is aligned with this bore 92 (FIG. 3).

Figure 8:
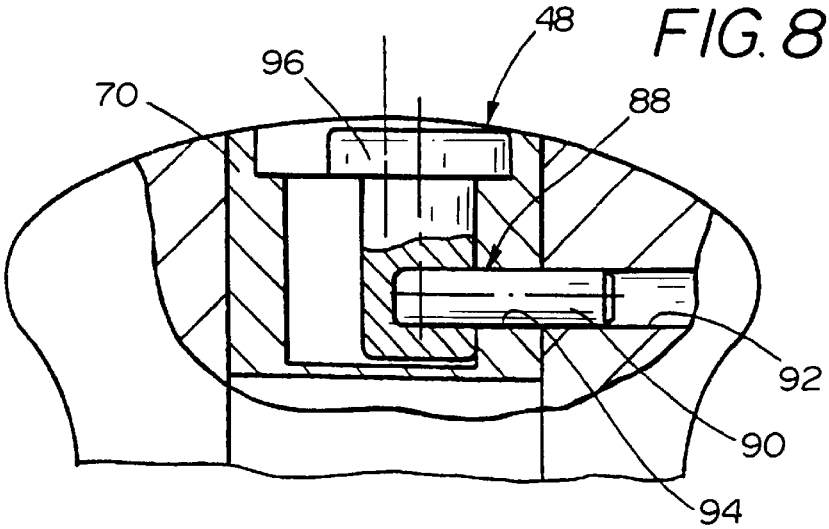
FIG. 8, is a section along the line VIII—VIII in FIG. 9.
Figure 9:
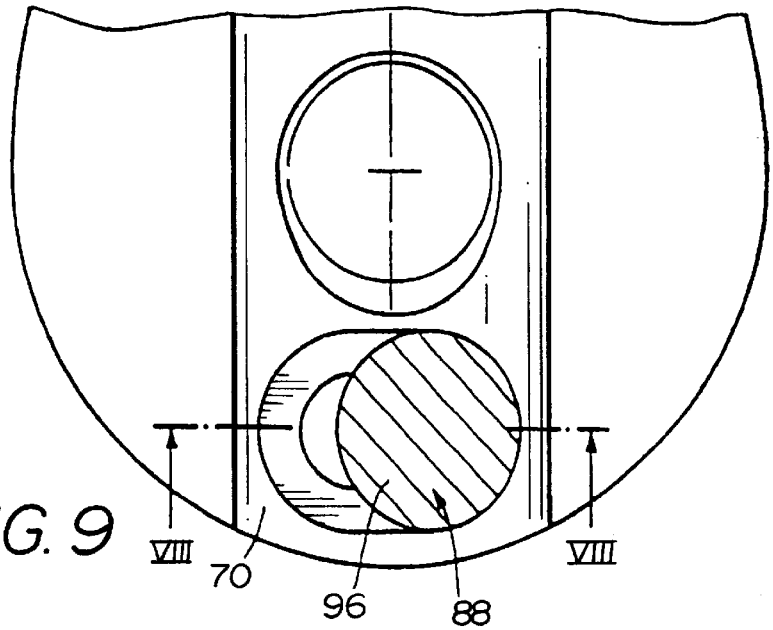
FIG. 9 is a top view showing part of the locking device.

In an embodiment of the locking device 88 represented in FIGS. 8 and 9, the locking pin 90 can be displaced via a slide 96 between a release position and a locking position, represented in the drawings. The slide is accessible from the front face 48 of the grip head and therefore can be easily operated by the thumb when the pole grip 10 has been grasped. In an alternative embodiment, a rotating mechanism in place of a slide would be conceivable.

Figure 10:
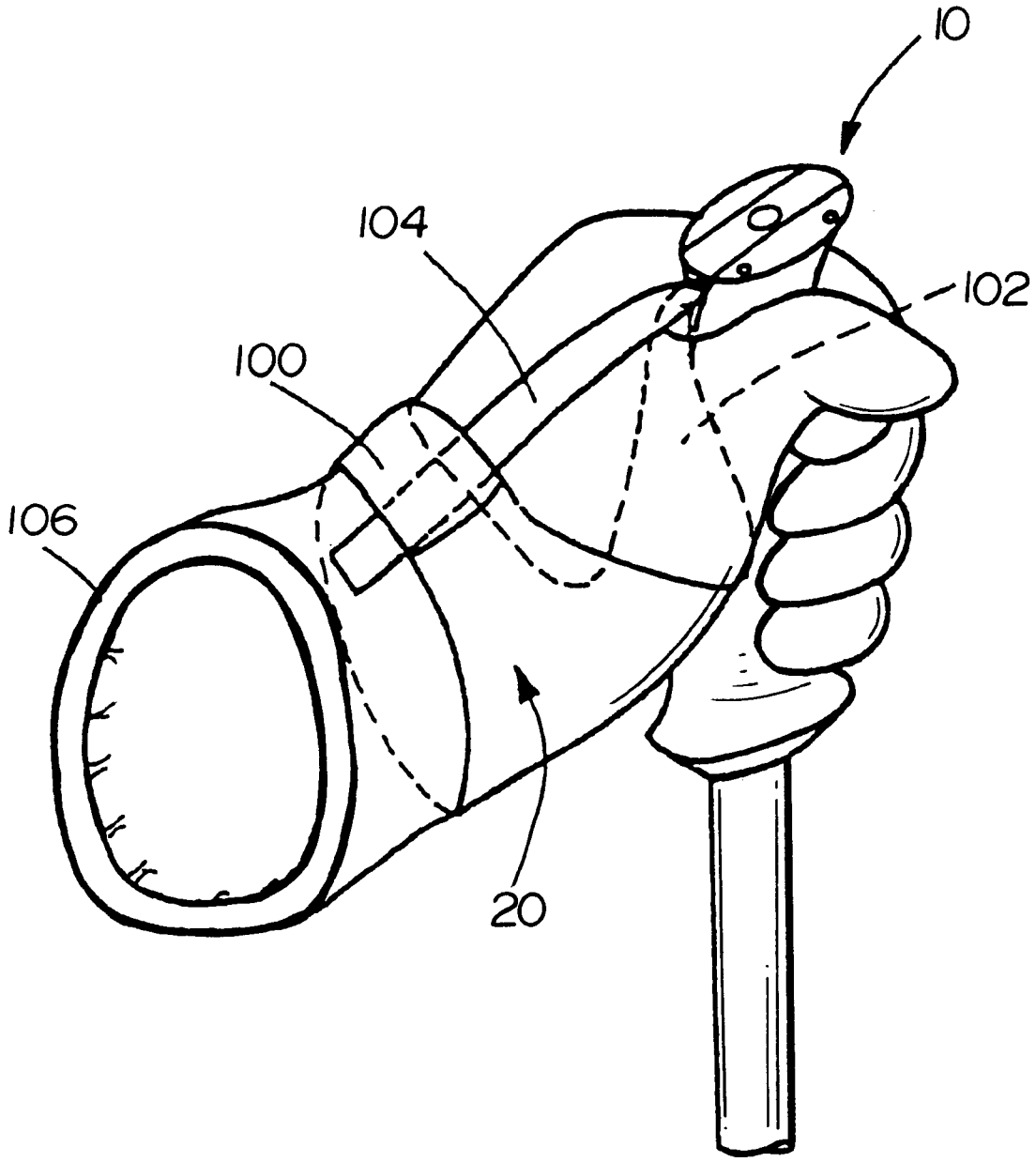
FIG. 10, is a diagrammatic representation of the pole grip in accordance with the present invention with a wrist strap in the position of use.

So that the pole grip 120 in accordance with the present invention with the wrist strap 20 can be used comfortably and easily, the wrist strap is designed in accordance with FIG. 10. The wrist strap 20 comprises a strap element 100, which tightly encloses the wrists and whose circumference can be adjusted by means of burr-type closures. The strap element 100 is widened on the inside of the hand and a connecting element 102 extends from it, which is connected at its free end with the first connecting element 24, or respectively 124. The first connecting element 24, or respectively 124, is furthermore connected with a tension element 104, which can be connected, preferably by means of a burr-type closure, over the back of the hand, with the strap element 100 enclosing the wrist. The tension element 104 preferably is made of an elastic material, for example a strip of elastic or the like. With the wrist strap 20 in place, the first connecting element 24, or respectively 124, extends finger-like away from the palm, so that when the pole grip 10 is grasped, the first connecting element 24, or respectively 124, can be inserted into the recess 18, or respectively 118, without further manipulation and is automatically locked there because of the resiliently seated second connecting element 30, or respectively 130. In one embodiment the wrist strap 20 can be integrated into a glove 105. Then the user of the pole grip in accordance with the present invention only needs to put the gloves on and to grip the pole grip 10. The glove 106 with its first connecting element 24, or respectively 124, is automatically locked with the pole grip 10. By means of this a connection with optimum functionality and simultaneously with security is achieved.

The pole grip 210 in accordance with a third exemplary embodiment represented in FIGS. 14 to 17 also has a base body 212 made, for example, from an injection molded element of plastic. The base body 212 is also provided with a cover 214 of an easily gripped material.

While in connection with the pole grip 10 and 110 of the first, or respectively the second exemplary embodiment, the actuating member 44, or respectively 144, was arranged and embodied in such a way that a control knob 46, or respectively 146, was arranged axially centered in relation to the pole grip, or respectively the pole tube 16, and penetrated an opening 47, or respectively 147, in the cover 72 of the triggering means 70, or respectively 170, and slightly projected from the front face 48, or respectively 148, of the pole head, with the pole grip 210 of the third exemplary embodiment the actuating member 244 is designed in such a way, and arranged in relation to the cover 272 of the triggering means 270 in such a way, that it can be actuated on both sides of the triggering means 270 from the front face 248, which is provided with two openings 247, 247'.

Figure 14:
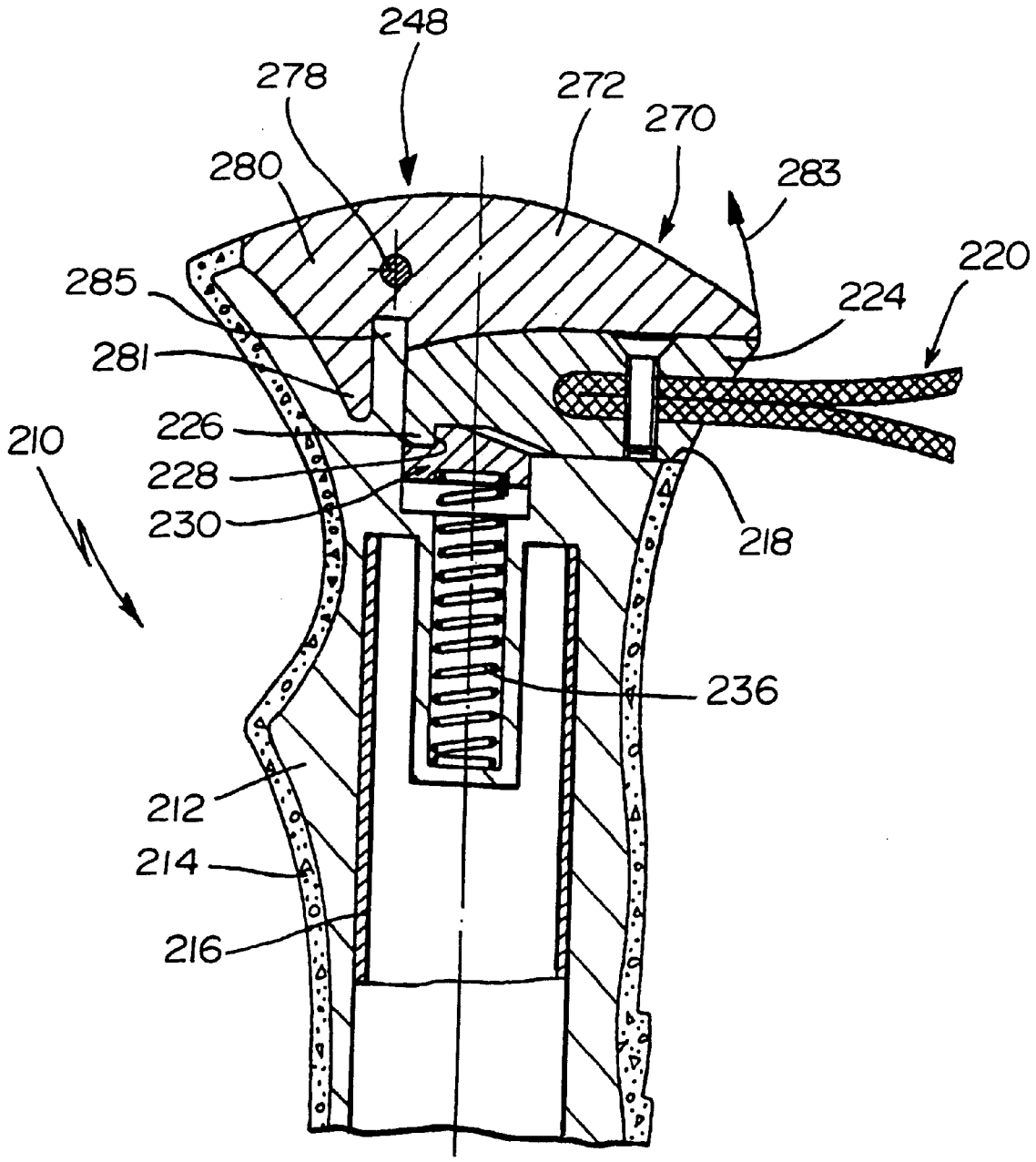

To this end the actuating member 244 has a U-shaped base 243, on whose two upwardly projecting parallel legs an actuating key 249, or respectively 251, each is formed in one piece, and whose base, or respectively connecting leg 245, constitutes the second connecting element 230. In accordance with FIG. 17B, the base leg 245 is arranged in a lower rear area. A recess 218 for the second connecting element 224 is formed between the two upright legs of the U-shaped base 243. As can be seen in FIG. 14, the first connecting element 224 has a detent protrusion 226, and the second connecting element 230 has a corresponding undercut detent edge 228. It can also be seen here that the recess 218 is not only bordered by the two upright legs of the U-shaped base 243, but also by the base body 212 and by the cover 272 of the triggering means 270.

As with the first exemplary embodiment, the wrist strap 220 is held in the first connecting element 224. Furthermore, and as in the first exemplary embodiment, the cover 272 of the triggering means 270 is pivotably seated around a shaft 278, wherein the shaft 278 is arranged offset in height near the inner end of the recess 218. Different from the first exemplary embodiment, the rear 280 of the cover 272 is provided with an undercut protrusion 281, which is supported on an upwardly projecting element 285 of the base body 212. The protrusion 281 is embodied to yield spring-elastically, so that under a tensile load the cover 272 pivots forward around its shaft 278 and is spread open in accordance with the arrow 283, wherein the protrusion 281 yields in a spring-elastic manner; following relief, the resilient protrusion 281 causes a return of the cover 272 into its initial position represented in FIG. 14.

The second connecting element 230, or respectively the base leg 245 of the U-shaped base 243 of the actuating member 244 identical with it, is provided on the underside 238 with a blind bore recess for receiving one end of an axial helical spring 236, whose other end is maintained and guided in a cup-shaped recess of the base body 212 extending into the pole tube 216. The corresponding movement limitation of the second connecting element 230 corresponds with that of the first exemplary embodiment. The two actuating keys 249 and 251 on the U-shaped base 243 are guided on the inside along the bordering surfaces of the cover 272 of the triggering means 270, and on the outside along the border of the remaining covering of the front face 248 of the grip head. Since for movement, the two actuating keys 249 and 251 are connected with each other, it is possible to selectively push the one or the other actuating key for releasing the first connecting element 224 from the pole grip 210.

In accordance with the partial FIGS. 17 A and B, the actuating keys 249 and 251 are provided with a soft layer 253 along their upper, or respectively actuating surface. It is understood that this actuating surface can also be embodied as a hard surface.

What is claimed is:

1. A pole handle for the pole tube of ski poles, hiking canes, trekking canes, and the like, which employs a wrist strap, the pole handle comprising:

a pole grip for attachment to the pole tube, said pole grip defining a recess;

a grip head in the form of an elastically yielding triggering means which is situated to define one side of said recess;

a first connecting element received in said recess, said first connecting element being adapted for connection to the wrist strap;

a second connecting element resiliently seated for movement in the longitudinal direction in said pole grip to extend into said recess; and a actuating member accessible from said grip head for moving said second connecting element counter to its resilient seating, wherein said first connecting means and said second connecting means are locked in said recess and releasable by engaging said second engaging element by said actuating member to move said second connecting element counter to its resilient seating.

2. The pole handle as defined in claim 1, wherein said recess extends laterally into said pole grip, and wherein said first connecting element includes a detent protrusion which engages said second connecting element to lock the first connecting element to the second connecting element.

3. The pole handle as defined in claim 1, wherein said triggering means includes a shaft about which said triggering means pivots.

4. The pole handle as defined in claim 3, wherein said shaft faces away from said recess.

5. The pole handle as defined in claim 1, further comprising:

a spring-elastic element situated between said pole grip and said triggering means, wherein said spring-elastic element is compressed by said triggering means when said triggering means is pivoted.

6. The pole handle as defined in claim 5, wherein said spring-elastic element is a cushion of a elastic material.

7. The pole handle as defined in claim 6, wherein said cushion is wedge-shaped and is seated displaceably in the direction of the wedge.

8. The pole handle as defined in claim 5, wherein said spring-elastic element is a spring, whose spring-elastic force can be adjusted.

9. The pole handle as defined in claim 1, wherein said triggering means includes a spring-elastic protrusion extending in the longitudinal direction of said pole grip, and wherein said pole grip includes a shoulder which engages said spring-elastic protrusion.

10. The pole handle as defined in claim 1, wherein said triggering means includes a center opening, and wherein said actuating member is received in said center opening.

11. The pole handle as defined in claim 1, wherein said first connection element includes a slit through which a rod of said second actuating member extends, said rod being fixedly connected against relative movement to said second connecting element and said actuating member and defining a center axis of said pole handle.

12. The pole handle as defined in claim 10, wherein a rod of said second connecting element includes a slit through which said first connecting element extends, said rod being fixedly connected against relative movement to said second connecting element and said actuating member and defining a center axis of said pole handle.

13. The pole handle as defined in claim 1, wherein said grip head includes two openings, and wherein said actuating member is received in said two openings.

14. The pole handle as defined in claim 13, wherein said actuating member includes two actuating keys each received in a respective one of said two openings.

15. The pole handle as defined in claim 14, wherein said actuating member is arranged as a U-shaped member having a base leg serving as said second connecting element.

16. The pole handle as defined in claim 15, further comprising:

a blind bore defined in said pole grip; and a helical compression spring situated in said blind bore, wherein said base leg engaging the upper end of said helical compression spring.

17. The pole handle as defined in claim 14, further comprising:

a soft coating covering for covering said two actuating keys.

18. The pole handle as defined in claim 1, further comprising:

a locking device for locking said triggering means.

19. The pole handle as defined in claim 18, wherein said locking device includes a locking pin which is displaced between a release position and a locking position.

20. The pole handle as defined in claim 19, wherein said locking device includes a slide accessible through said grip head, said slide serving to displace said locking pin.

21. The pole handle as defined in claim 1, wherein said first connecting element being adapted to be connected to a wrist strap integrated into a glove.

* * * * *